US008597495B2

(12) United States Patent
Colyar

(10) Patent No.: US 8,597,495 B2
(45) Date of Patent: Dec. 3, 2013

(54) PARTIAL UPRADING UTILIZING SOLVENT DEASPHALTING AND DAO HYDROCRACKING

(75) Inventor: James J. Colyar, Newtown, PA (US)

(73) Assignee: IFP Energies Nouvelles, Rueil-Malmaison (FR)

( * ) Notice: Subject to any disclaimer, the term of this patent is extended or adjusted under 35 U.S.C. 154(b) by 876 days.

(21) Appl. No.: 12/658,373

(22) Filed: Feb. 12, 2010

(65) Prior Publication Data

US 2011/0198266 A1 Aug. 18, 2011

(51) Int. Cl.
*C10G 7/00* (2006.01)

(52) U.S. Cl.
USPC ..... 208/93; 208/86; 208/110

(58) Field of Classification Search
USPC ..... 208/95, 85, 86, 92, 93, 94, 106, 107, 208/108, 110
See application file for complete search history.

(56) References Cited

U.S. PATENT DOCUMENTS

| | | | | |
|---|---|---|---|---|
| 7,381,320 | B2 | 6/2008 | Iqbal et al. | |
| 7,815,870 | B2 * | 10/2010 | Lott et al. | 422/187 |
| 2004/0118745 | A1 * | 6/2004 | Rettger et al. | 208/86 |
| 2007/0034550 | A1 | 2/2007 | Hedrick et al. | |
| 2008/0011643 | A1 * | 1/2008 | Lenglet et al. | 208/58 |
| 2008/0078552 | A1 * | 4/2008 | Donnelly et al. | 166/303 |
| 2008/0289999 | A1 * | 11/2008 | Lenglet | 208/309 |

* cited by examiner

*Primary Examiner* — Randy Boyer
*Assistant Examiner* — Juan Valencia

(57) ABSTRACT

The described invention discloses an innovative solvent deasphalter and hydroconversion-processing configuration for converting bitumen or heavy oils to produce a transportable synthetic crude oil (SCO). The innovative processing scheme disclosed herein maximizes the synthetic crude oil yield at a minimal investment compared to currently known methods.

8 Claims, 1 Drawing Sheet

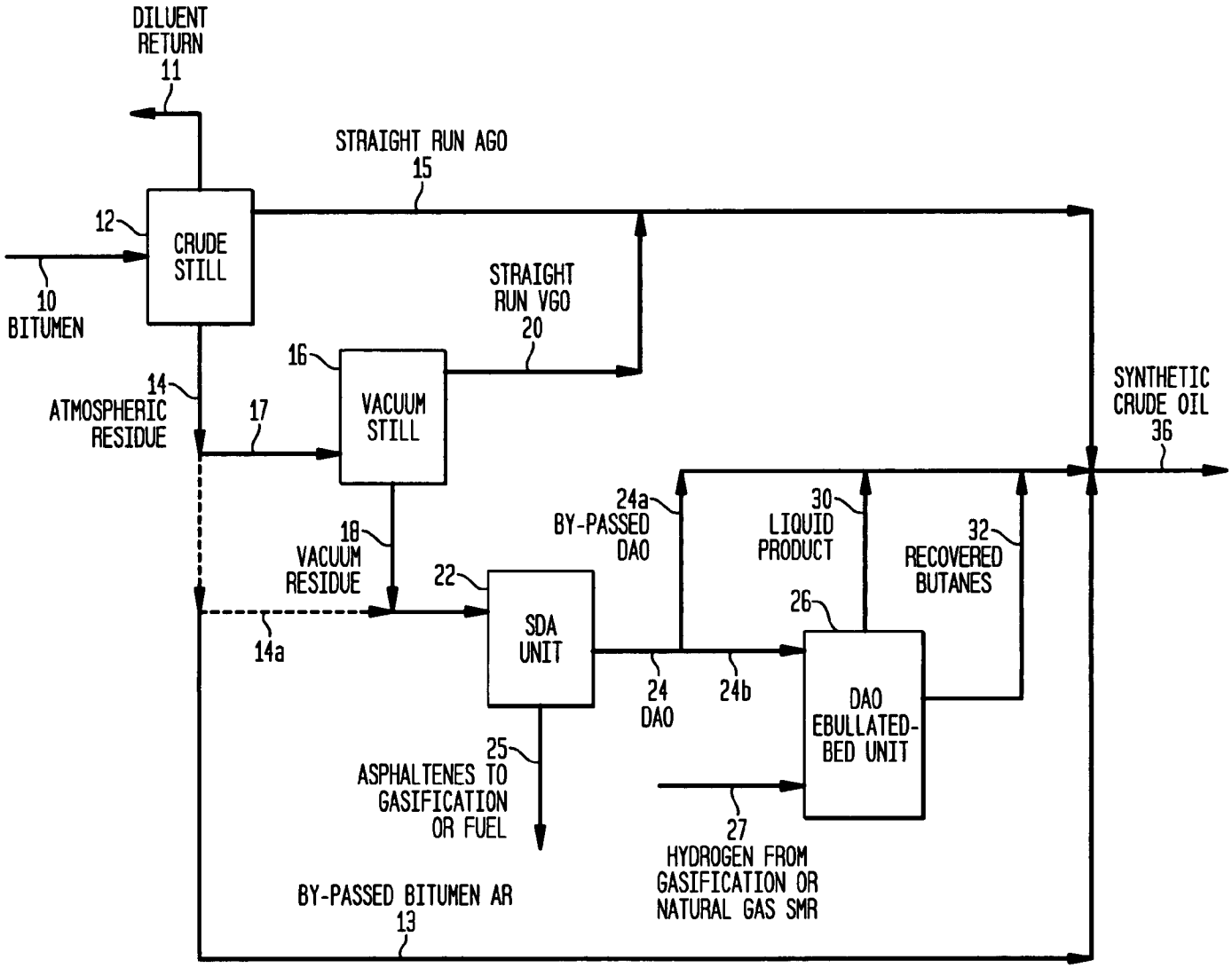
SYNTHETIC CRUDE OIL 36
32 RECOVERED BUTANES
DAO EBULLATED-BED UNIT
30 LIQUID PRODUCT
26
24b
27 HYDROGEN FROM GASIFICATION OR NATURAL GAS SMR
24a BY-PASSED DAO
24 DAO
STRAIGHT RUN VGO 20
SDA UNIT
25 ASPHALTENES TO GASIFICATION OR FUEL
STRAIGHT RUN AGO 15
22
VACUUM STILL
18 VACUUM RESIDUE
BY-PASSED BITUMEN AR 13
16
17
14a
DILUENT RETURN 11
CRUDE STILL
14 ATMOSPHERIC RESIDUE
12
10 BITUMEN

PARTIAL UPRADING UTILIZING SOLVENT DEASPHALTING AND DAO HYDROCRACKING

FIELD OF THE INVENTION

The described invention is an innovative solvent deasphalting, hydroconversion processing configuration for converting bitumen or heavy oils and producing a transportable synthetic crude oil (SCO). The invention results in a high yield of specification SCO which will contain greatly reduced or nil undesirable asphaltenes, no undesirable vacuum bottoms or coke product and is accomplished with minimal investment cost compared to currently known methods. Synthetic crude is the primary product from a bitumen/extra heavy oil upgrader facility used in connection with oil sand production. SCO can also be output from an oil shale extraction process. The properties of the synthetic crude depend to a large extent on the feedstock quality and on the process used in the upgrading. Relative to the feedstock, SCO is lower in sulfur, has an API gravity in the 20-35° range, and is also known as "upgraded crude".

In this invention, the total heavy oil or bitumen feedstock is initially fractionated in a crude or atmospheric still to produce straight-run atmospheric gas oil (AGO), atmospheric residue (AR), and the light diluent which is used to transport the bitumen or heavy oil from the field. The diluent is returned to the field. All or a large portion of the AR stream is sent to a vacuum still to produce straight run vacuum gas oil (VGO) and a vacuum residue feedstream. In one embodiment, a portion of the AR bypasses the vacuum still and is thereafter sent downstream for blending in the final synthetic crude oil product.

The vacuum residue feedstream and/or a portion of the atmospheric residue feedstream are thereafter fed to a solvent deasphalter process unit to create a deasphalted oil (DAO) stream and an asphaltene stream. The asphaltene product stream can be utilized for fuel or as a feed to a gasification unit to produce hydrogen and/or syngas for upstream oil production. All or a portion of the DAO stream is processed along with a hydrogen stream in an ebullated-bed reactor operating at high severity conditions to produce a greater than seventy percent (70%) and preferably greater than seventy-five (75%) percent conversion rate of the vacuum residue portion of ebullated-bed feedstream. The ebullated-bed products are thereafter blended with the portion of the DAO stream that was not processed in the ebullated-bed reactor, bypassed atmospheric residue, the straight run AGO, and the straight run VGO to produce a synthetic crude oil.

Once the level of severity in the ebullated-bed unit is set (primarily the vacuum residue conversion level), the fraction of the AR that bypasses the vacuum still or the fraction of the DAO that bypasses the ebullated-bed conversion unit can be set to attain the required final SCO qualities. Hydrogen for the ebullated-bed unit can be obtained via a natural gas-steam reformer or via gasification of a portion of the ebullated-bed heavy product, asphaltenes, or straight run vacuum residue. The invention results in a high yield of specification SCO, no coke product and is accomplished with minimal investment and operating costs. Unlike much of the SCO commercially produced, the invention SCO may contain both straight run and conversion vacuum residue. The SCO will be stable as a result of removal of feedstock asphaltenes, selection of optimal operating conditions in the ebullated-bed conversion unit and the proper blending technique to combine the bypassed bitumen/heavy oil AR or DAO and the conversion products.

BACKGROUND OF THE INVENTION

The world's higher quality light natural crude oils are those generally having an API gravity greater than 30° with sulfur content less than 0.5 percent. These high quality light natural crudes cost the least to refine into a variety of highest value end products including petrochemicals and therefore command a price premium. More important, however, world refinery capacity is geared to a high proportion of light natural crude oils with an API of 30° or higher.

It is generally accepted that world supplies of light crude oils recoverable by the conventional means of drilling wells into reservoirs and the use of nature's pressure, or by pumping to recover the oil, will be diminished to the extent that in the coming decades these supplies will no longer be capable of meeting the world demand.

To find relief from oil supply shortage it will be necessary to substantially increase processing of the vast world reserves of coal and viscous oil, bitumens in tar sands and kerogens in oil shale. These sources of crude oil remain largely unexploited today although recovery of oil from tar sands is in practice in Canada. The development of technology for the production of synthetic oil as an alternative to the light crude oil found in nature continues to be plagued by the large capital investments required in recovery and production facilities and a long wait for return on investment. In addition, large expenditures are required to construct or retrofit refineries for synthetic oils recovered from heavy oils and bitumens. In addition, present synthetic oil plants for processing heavy oils, or bitumens from tar sands, have focused more on the development of systems for recovery and production than on energy efficiency, maximization of yield and high environmental processing standards. Except for South Africa's Sasol process, which benefits from low cost labor used in coal mining, straight coal liquefaction is not yet cost competitive with synthetic oil produced from tar sands bitumen or heavy oils.

It is therefore of considerable importance that methods are found to produce synthetic crudes to replace the rapidly depleting reserves of light natural crudes available from conventional sources and at a cost at least approaching these crudes and fully competitive with the crudes being recovered at higher cost from under the sea or from frontier areas such as the extreme north with its rigorous climate. It is also important that light synthetic crudes are comprised in desired proportions of a mixture of aromatic, naphthenic and paraffinic components as these three families of compounds comprise essential feedstock to refinery capacity producing today's transportation fuels and feedstocks for the petrochemical industry.

Accordingly, applicants have disclosed an invention which is an innovative solvent deasphalting, hydroconversion processing configuration for converting these heavy oils and/or bitumens to produce a transportable synthetic crude oil. In the invention, the heavy oil or bitumen feedstock is only partially processed in the hydroconversion unit, there is no secondary hydrotreating, nor is there any coke to dispose of using this novel process.

The entire heavy oil or bitumen feedstock is first fractionated in a crude still and thereafter all or a portion of the atmospheric residue and/or vacuum residue created in the fractionation process is fed to a solvent deasphalting process unit. The deasphalter asphaltene product is used as fuel or sent to gasification. All or a portion of the deasphalter DAO product is then fed to an ebullated-bed hydroconversion reactor along with a hydrogen stream. The hydrogen stream can be produced through gasification of the SDA asphaltenes. The ebullated-bed reactor operates at relatively high severity and gives a conversion rate of greater than seventy percent (70%) and preferably greater than seventy-five (75%) percent. The entire converted products from the 5 ebullated-bed reactor are thereafter mixed with the straight-run distillates (AGO, VGO), by-passed DAO, and, in some cases, bypassed atmospheric residue from the heavy crude oil or bitumen feedstock plus produced butanes to create the final synthetic crude product.

These and other features of the present invention will be more readily apparent from the following description with reference to the accompanying drawing.

SUMMARY OF THE INVENTION

An objective of the invention is to provide an innovative processing configuration for maximizing feedstock processing capacity and liquid SCO yield at minimal required investment.

Another objective of the invention to allow the processing of bitumen or heavy oil with no solid coke product, which can present a disposal problem.

It is a further objective of the present invention to utilize maximum size and throughput ebullated-bed reactors for maximum total heavy oil or bitumen feedrate and SCO production.

It is another object of the invention to further reduce the required plant investment by bypassing either a portion of the atmospheric residue or the DAO stream from being processed in the ebullated-bed reactor.

It is yet a further object of the present invention to minimize or completely remove all feedstock and conversion product asphaltenes from the final SCO product to insure its stability and compatibility.

The heavy oil or bitumen feedstock is initially fractionated in crude still to produce straight-run AGO, atmospheric residue, and diluent which is returned to the field. The diluent is added to the raw bitumen at the field in order to transport the blend to the processing complex. A portion of the atmospheric residue is then sent to a vacuum still for further fractionation and the production of a straight run VGO and a vacuum residue stream. The vacuum residue feedstream and/or the atmospheric residue feedstream are thereafter processed along with a hydrogen stream in solvent deasphalting unit to produce deasphalted oil and an asphaltene product. A portion of the deasphalted oil is further processed along with a hydrogen stream in an ebullated-bed reactor system operating at relatively high severity conditions to produce a greater than seventy-five (75%) percent conversion rate. The ebullated-bed products are thereafter blended with the atmospheric residue which was by-passed and the straight run distillates (VGO and AGO) to produce a synthetic crude oil. The asphaltene stream can be utilized or sold as fuel or can be gasified and the hydrogen created from such gasification is utilized in the ebullated-bed reactors.

Once the level of severity in the ebullated-bed unit is set, the fraction of the AR stream which bypasses the deasphalting and ebullated-bed conversion steps and/or the fraction of the DAO which bypasses the ebullated-bed step can be determined to attain the required final SCO qualities. Hydrogen for the ebullated-bed unit can be obtained via a natural gas-steam reformer or via gasification of the asphaltene product from the solvent deasphalter. The invention results in a high yield of stable and compatible specification SCO, no undesirable coke product and is accomplished with minimal investment and operating costs.

More particularly, the present invention describes a novel process configuration process for converting heavy oil or bitumen feedstocks to transportable synthetic crude oil comprising:

a) feeding a bitumen or heavy oil feedstock to a crude still to provide an atmospheric residue stream, a straight run atmospheric gas oil stream, and diluent stream; and b) feeding a portion of said atmospheric residue stream to a vacuum fractionator to create a vacuum residue stream and a straight run vacuum gas oil stream; and c) feeding said vacuum residue stream along with a portion of said atmospheric residue stream that was not processed in step b) to a solvent deasphalter to produce a deasphalted oil stream and an asphaltene stream;

d) feeding a portion of the deasphalted oil stream and a hydrogen stream to an ebullated-bed reactor system to create a full-range liquid conversion product stream and a recovered butanes stream; and e) blending said full-range liquid conversion product stream, the portion of the deasphalted oil stream that was not processed in step d) above, the portion of the atmospheric residue stream that was not processed in steps b) or c), said straight run vacuum gas oil stream, said recovered butanes stream and said straight run atmospheric gas oil stream to create a synthetic crude oil.

In one embodiment the heavy oil or bitumen feedstream has the following properties: API gravity less than 15°, sulfur content greater than 3 W % and vacuum residue content greater than 35%. In another embodiment, a portion of the atmospheric residue stream bypasses the vacuum still and is fed to the ebullated bed unit along with the vacuum residue stream.

The ebullated-bed reactor operates at the following range of conditions: reactor total pressure of 1,000 to 3,000 psia, reactor temperature of 750 to 850° F., hydrogen feedrate of 1,500 to 12,000 SCF/Bbl, liquid hourly space velocity of 0.1 to 1.5 $hr^{-1}$, and a daily catalyst replacement rate of 0.05 to 1.0 lb/Bbl of feedstock.

Generally such hydroprocessing is in the presence of catalyst containing group VI or VIII metals such as platinum, molybdenum, tungsten, nickel, cobalt, etc., in combination with various other metallic element particles of alumina, silica, magnesia and so forth having a high surface to volume ratio. More specifically, catalyst utilized for hydrodemetallation, hydrodesulfurization, hydrodenitrification, hydrocracking etc., of heavy oils and the like are generally made up of a carrier or base material; such as alumina, silica, silicaalumina, or possibly, crystalline aluminosilicate, with one more promoter(s) or catalytically active metal(s) (or compound(s)) plus trace materials. Typical catalytically active metals utilized are cobalt, molybdenum, nickel and tungsten; however, other metals or compounds could be selected dependent on the application.

The ebullated-bed reactor system maybe comprised of one, two or three stages in series and may incorporate phase separation between the reactor stages to offload the gas from the first stage reactor.

In the process according to the invention, the overall conversion percentage of the feedstream processed in the ebullated-bed reactor hydrocarbon feedstream is preferably greater than 50% wt, and more preferably greater than 65%, more preferably greater than 70% and again more preferably greater than 75%.

In one embodiment, the hydrogen stream from step d) above is obtained via gasification of the SDA asphaltenes.

Between 0 and 100% percent of the atmospheric residue stream from step a) above may bypass step b) and is thereafter fed into the solvent deasphalter of step c) along with the vacuum residue stream. Additionally, between 10 and 80 percent of the DAO produced in step c) may also bypass the ebullated-bed reactor system in step c).

Depending upon the quality of the SCO product desired, a portion of the straight run atmospheric gas oil stream, vacuum gas oil stream or full-range liquid conversion product stream may not be included in the synthetic crude.

Also depending upon the quality of the SCO product desired, the straight run vacuum and atmospheric gas oil streams may be hydrotreated or hydrocracked prior to be blended into the synthetic crude oil.

BRIEF DESCRIPTION OF THE DRAWINGS

FIG. 1 is a schematic flowsheet of the high conversion partial upgrading process of heavy oil or bitumen feedstock using solvent deasphalting and DAO hydrocracking.

DETAILED DESCRIPTION OF THE INVENTION

The heavy oil or bitumen stream 10 enters the plant battery limits. Typically, this stream contains 10-40% light diluent which is used to transport the bitumen from the field to the processing complex. The heavy oil or bitumen feedstream is first processed through a crude atmospheric fractionator 12 to create an atmospheric residue stream 14 nominally boiling above 650° F. , a straight run atmospheric gas oil stream 15, and a light diluent stream 11 which is returned to the field. Although not shown in the drawing and depending upon the quality of the SCO product desired, the straight run atmospheric gas oil stream 15 may be hydrotreated and or hydrocracked prior to being blended in the SCO product 36. The atmospheric fractionator 12 is also called an atmospheric still. As shown in the drawing, a portion of the atmospheric residue stream 14 may bypass the downstream processing steps and be blended into the SCO product 36. This bypass is shown as stream 14*a* (bypass vacuum fractionator) and stream 13 (bypasses all processing).

The net atmospheric residue stream 14 from the crude atmospheric fractionator 12 is thereafter sent to a vacuum fractionator 16 to create a vacuum residue stream 18 nominally boiling above 975° F. and a straight run vacuum gas oil (VGO) stream 20 nominally boiling between 650° F. and 975° F. The vacuum fractionator 16 is also commonly called a vacuum still. As shown as a dotted line in the drawing, a portion of the atmospheric residue stream 14, generally between 10% and 80%, may be directly sent to the solvent deasphalting (SDA) unit 22. This stream is labeled in the drawing as 14*a* and is sent directly to the solvent deasphalter unit 22 after mixing with the vacuum residue stream 18. The straight run VGO stream 20 is thereafter routed together with the straight run AGO stream 15 to the final SCO product 36. Although not shown in the drawing, the straight run atmospheric gas oil stream 15 and the straight run VGO stream 20 may be hydrotreated and or hydrocracked prior to being blended in the SCO product 36.

The vacuum residue feed stream 18 and any portion of the atmospheric residue stream 14*a* that that bypassed the vacuum fractionator 16 is thereafter sent to a solvent deasphalter 22 unit (SDA) where it is separated into deasphalted oil ("DAO") stream 24 and an asphaltene stream 25.

The solvent utilized in the SDA unit 22 may be any suitable hydrocarbonaceous material which is a liquid within suitable temperature and pressure ranges for operation of the countercurrent contacting column, is less dense than the feed streams 18, 14*a*, and has the ability to readily and selectively dissolve desired components of the feed streams 18, 14*a* and reject the asphaltic materials also commonly known as pitch or asphaltenes. The solvent may be a mixture of a large number of different hydrocarbons having from 3 to 14 carbon atoms per molecule, such as light naphtha having an end boiling point below about 200° F. (93° C.).

Preferably, the SDA unit 22 is operated with a $C_3/C_4/C_5$ solvent to obtain a high DAO yield such that the DAO can be treated in a classic fixed-bed reactor or more preferably due to high feedstock contaminant metals content, in an ebullated-bed unit. More specifically, the solvent may be a relatively light hydrocarbon such as ethane, propane, butane, isobutane, pentane, isopentane, hexane, heptane, the corresponding mono-olefinic hydrocarbons or mixtures thereof. Preferably, the solvent is comprised of paraffinic hydrocarbons having from 3 to 7 carbon atoms per molecule and can be a mixture of two or more hydrocarbons. For instance, a preferred solvent may be comprised of a 50 volume percent mixture of normal butane and isopentane.

The solvent deasphalting conditions include a temperature from about 50° F. (10° C.) to about 600° F. (315° C.) or higher, but the deasphalter 22 operation is preferably performed within the temperature range of 100° F. (38° C.) to 400° F. (204° C.). The pressures utilized in the solvent deasphalter 22 are preferably sufficient to maintain liquid phase conditions, with no advantage being apparent to the use of elevated pressures which greatly exceed this minimum. A broad range of pressures from about 100 psig (689 kPag) to 1,000 psig (6,900 kPag) are generally suitable with a preferred range being from about 200 psig (1,380 kPag) to 600 psig (4,140 kPag).

In the SDA Unit, an excess of solvent to charge stock should preferably be maintained. The solvent to charge stock volumetric ratio should preferably be between 2:1 to 20:1 and preferably from about 3:1 to 9:1. The preferred residence time of the charge stock in the solvent deasphalter 11 is from about 10 to 60 minutes.

The asphaltene stream 25 from the solvent deasphalter unit 22 can be utilized as fuel or can be sent to a gasification plant (not shown) where it produces hydrogen stream 27 that is required for the ebullated-bed unit 26 and can also produce power and/or medium BTU syngas for the upgrader and upstream resource recovery. Gasification of this stream could include capture of the carbon dioxide which is a by-product of the gasification process.

A portion of the DAO stream 24 from the solvent deasphalter unit 22 is thereafter combined with a hydrogen stream 27 and sent to an ebullated-bed reactor system 26 for hydroconversion. This stream is designated as stream 24*b*. Depending upon the cost and availability of natural gas and plant requirements, the hydrogen consumption stream 27 can be obtained via steam methane reforming or gasification of a suitable heavy process stream, including the asphaltene (pitch) product from the deasphalter. As mentioned above, a portion of the DAO stream, generally between 10% and 80%, bypasses the ebullated-bed reactor unit 26 and is shown in the drawing as 24*a*. This DAO bypass stream does not contain a significant quantity of undesirable asphaltenes and is thereafter directly blended in the final SCO product stream 36.

The ebullated-bed unit 26 utilizes one or more high conversion ebullated-bed reactors in series. The net DAO vacuum residue stream 24*b* is hydrocracked and hydrogenated in the ebullated-bed reactor(s) 22. The conversion of vacuum residue is high and preferably in the range of 75 to 90%. A full range (C5+) product 30 and recovered butanes 32 are produced and are sent to SCO blending 36. In one embodiment, the small quantity of unconverted DAO vacuum residue can be separated from the full range ebullated-bed product and excluded from the SCO product. In this embodiment, the unconverted residue could be utilized as gasifier feedstock. The combination of streams 15, 20, 24*a*, 30, 32 and 13 form the final SCO product 36.

This invention will be further described by the following examples, which should not be construed as limiting the scope of the invention. The first example illustrates the processing configuration where a portion of the AR stream bypasses the SDA and ebullated-bed units and all the DAO is processed in the ebullated-bed unit. In the second example, all the AR is processed in the SDA unit, however a portion of the DAO is bypassed around the ebullated-bed unit.

EXAMPLE 1

A total of 100,000 BPSD of bitumen is processed utilizing the novel configuration disclosed herein. Inspections on the bitumen feedstock are shown in Table 1. The 100,000 BPSD flowrate and bitumen inspections are net of the light diluent which is used to transport the heavy feedstock from the field. The objective of the processing configuration is to produce a maximum yield of stable, transportable SCO meeting Canadian pipeline specifications. These specifications are API Gravity greater than 19° and a 7° C. viscosity less than 350 cSt. The amount of bitumen atmospheric residue bypassed is determined by attaining the partially upgraded SCO specifications. In this example, 100 KBPSD of total crude were processed in the crude still, 71.3% of the atmospheric residue is sent to vacuum fractionation and 28.7% of the atmospheric residue bypasses the processing units and is blended with the ebullated-bed products and eventually routed to final SCO. The crude still also produces 17,600 BPSD of AGO.

Based on the iterative calculation, 58,700 BPSD of the 82,400 BPSD of total atmospheric residue from the bitumen is routed to the vacuum still to produce VGO and a vacuum residue. The other portion of the atmospheric residue (23,700 BPSD) bypasses the vacuum still and is routed to final SCO blending. The straight run AGO (17,600 BPSD) and VGO (19,700 BPSD) are routed for blending into the final SCO product. Flowrates of the major streams are shown in Table 2.

This vacuum residue feedstream is thereafter sent to the Solvent Deasphalting Unit (SDA) to produce an asphaltene product (to fuel or gasification) and Deasphalted Oil (DAO) feedstream. The total SDA Unit feedrate is 39.0 KBPSD. Typically a pentane or similar solvent is utilized in the SDA Unit to maximize the yield of DAO and minimize the asphaltene yield. In this example, the SDA Unit produces 27.0 KBPSD of DAO and 12.0 KBPSD of asphaltenes. The total DAO product, which contains significant CCR and metals, is sent to the ebullated-bed hydrocracking unit.

A gasification plant could be specified to process the SDA asphaltenes (12.0 KBPSD). This gasification plant produces 54.4 MMSCFD of hydrogen, which is that, required for the H-Oil$_{DC}$ Unit and can also produce power and/or medium BTU syngas for the upgrader and upstream resource recovery. This is particularly advantageous for a bitumen SAGD (Steam Assisted Gravity Drainage) operation. It is estimated for this example, that in addition to the required hydrogen, the gasification plant could produce 48,500 MM Btu/Day of excess syngas.

The feedrate to the DAO ebullated-bed conversion unit is 27.0 KBPSD. The DAO ebullated-bed operates at a residue conversion level of >75 W % which has been demonstrated for Western Canadian feedstocks. The products from the ebullated-bed unit will contain a very low concentration of asphaltenes and will be stable. Prior Axens research has demonstrated that the blend of ebullated-bed products and straight run bitumen is stable. The total hydrogen consumption in the ebullated-bed unit is 54.4 MM SCFD and as discussed above, can be obtained via gasification of the SDA asphaltenes. The liquid product yields from the ebullated-bed unit are shown in Table 2 and sum to 29,200 BPSD, 8% higher than the 27,000 BPSD feedrate as a result of volume expansion due to hydrogenation.

The final SCO product is a blend of the bypassed atmospheric residue from the bitumen, the overheads from the distillation units, the ebullated-bed total liquid product and all available butanes. Table 3 shows the components of the final SCO blend and important inspections; the bitumen feedstock used for the example is also shown for comparison. The SCO rate is 90.8 KBPSD with 20.4° API gravity and 2.5 W % sulfur. The typical Canadian pipeline viscosity is met. The SCO contains 20.7 V % material boiling greater than 975° F., compared to 50.6 V % in the heavy crude. The SCO liquid yield as a percentage of the crude rate is 90.8 V %. This is a high value considering that a portion of the crude (i.e., the asphaltenes) utilized to produce the required hydrogen and upstream energy requirements.

TABLE 1

Feed Inspections

| Stream | Bitumen |
|---|---|
| Gravity, ° API | 9.3 |
| Sulfur, W % | 4.3 |
| Nitrogen, W % | 0.40 |
| Conradson Carbon Residue, W % | 13.6 |
| Distillation, V % | |
| IBP-350° F. | 0 |
| 350-650° F. | 17.6 |
| 650-975° F. | 31.8 |
| 975° F.$^+$ | 50.6 |

TABLE 2

Example 1: Summary of Flowrates
Basis: 100 KBPSD of Undiluted Bitumen

| Stream | Flowrate, kBPSD |
|---|---|
| Bitumen to Crude Still | 100.0 |
| AGO to SCO Blending | 17.6 |
| Total Atmospheric Residue | 82.4 |
| Atmospheric Residue Bypassed | 23.7 |
| Atmospheric Residue to Vacuum Still | 58.7 |
| VGO to SCO Blending | 19.7 |
| Vacuum Residue to SDA Unit | 39.0 |
| SDA Asphaltenes to Gasification or Fuel | 12.0 |
| SDA DAO to Ebullated-Bed Unit | 27.0 |
| Ebullated-Bed Products ($C_5^+$) | 29.2 |
| Naphtha | 6.5 |
| Diesel | 10.2 |
| VGO | 8.2 |
| Unconverted Residue | 4.3 |
| Total SCO | 90.8 |
| Hydrogen Required, MMSCFD | 54.4 |
| Syngas Export from Gasifier, MM Btu/Day | 48,500 |

TABLE 3

| SCO Yield | | | |
|---|---|---|---|
| | Units | Feed | SCO |
| Total SCO | BPSD | 100,000 | 90,837 |
| Yield on Crude | V % | — | 90.84 |
| Gravity | ° API | 9.3 | 20.4 |
| Sulfur | W % | 4.29 | 2.50 |
| Nitrogen | W % | 0.40 | 0.24 |
| Conradson Carbon Residue | W % | 13.6 | 5.3 |
| Nickel + Vanadium | Wppm | 290 | 99 |
| Distillation | | | |
| $C_4$-350° F. | V % | — | 7.8 |
| 350-650° F. | V % | 17.6 | 30.6 |
| 650-975° F. | V % | 31.8 | 40.9 |
| 975° F.$^+$ | V % | 50.6 | 20.7 |
| Viscosity @7° C. | cSt | — | <350 |

EXAMPLE 2

In this example, the same feedstock as in Example 1 (see Table 1) is processed to produce a transportable SCO. A total of 100,000 BPSD of bitumen or heavy oil crude was processed. The 100,000 BPSD flowrate and bitumen inspections are net of the light diluent which is used to transport the heavy feedstock from the field. The objective of the processing configuration is to produce a maximum yield of stable, transportable SCO meeting Canadian pipeline specifications. These specifications are API Gravity greater than 19° and a 7° C. viscosity less than 350 cSt. In this case, all of the bitumen is processed in the atmospheric still, vacuum still and SDA Unit. A portion of the SDA DAO product bypasses the ebullated-bed hydrocracking unit and is routed to SCO blending. The amount of bypassed DAO is determined by attaining the partially upgraded SCO specifications. In this example, 100 KBPSD of total crude were processed in the crude still, 53.3% of the SDA DAO is sent to the ebullated-bed unit and 46.7% of the DAO bypasses the ebullated-bed and is routed to SCO blending.

Flowrates of the major streams are shown in Table 4. The crude still separates the 100,000 BPSD of bitumen into 17,600 BPSD of AGO and 82,400 BPSD of AR. The vacuum still is fed the entire AR stream and produces 27,700 BPSD of VGO and 54,700 BPSD of vacuum residue. The entire vacuum residue product is fed to the SDA Unit.

The total SDA Unit feedrate is 54.7 KBPSD. Typically a pentane solvent is utilized in the SDA Unit to produce deasphalted oil (DAO) and an asphaltene stream. In this example, the SDA Unit produces 37.9 KBPSD of DAO and 16.9 KBPSD of asphaltenes. A portion of the DAO is sent to a high conversion ebullated-bed hydroconversion unit. The other portion of the DAO bypasses the conversion unit and is routed to SCO blending. The split is determined by attaining partially upgraded SCO specifications of a minimum of 19° API gravity and a viscosity of less than 350 cSt at 7° C. In this example, 100 KBPSD of total crude are processed, 37.9 KBPSD of DAO are produced in the SDA Unit; 20.2 KBPSD is sent to a H-Oil$_{DC}$ ebullated-bed reactor Unit and 17.7 KBPSD bypasses the H-Oil$_{DC}$ ebullated-bed reactor Unit and is sent for blending into the final synthetic crude oil product.

The gasification plant can be specified to process the SDA asphaltenes (16.9 KBPSD). This gasification plant produces 40.5 MMSCFD of hydrogen, which is that, required for the H-Oil$_{DC}$ ebullated-bed reactor Unit and can also produce power and/or medium BTU syngas for the upgrader and upstream resource recovery. It is estimated for this example, that in addition to the required hydrogen, the gasification plant would produce 81,200 MM Btu/Day of excess syngas.

The feedrate to the DAO ebullated-bed conversion unit 20.2 KBPSD and is near the maximum rate for a single train, single stage unit with a specified maximum reactor size. This reactor size is normally limited by either fabrication or transportation constraints. The ebullated-bed reactor unit operates at a residue conversion level >80 W % which has been demonstrated for Western Canadian feedstocks. The products from ebullated-bed reactor unit will contain insignificant asphaltenes and will be stable. Prior research has demonstrated that the blend of H-Oil $_{DC}$ products and straight run bitumen or heavy oil components is extremely stable. The total hydrogen consumption in the ebullated-bed reactor Unit is 40.5 MM SCFD and can be obtained via gasification of the SDA asphaltenes.

The final SCO product is a blend of the bypassed DAO, the overheads from the distillation units (VGO and AGO), the H-Oil$_{DC}$ $C_5^+$ total product and all available butanes. Table 5 shows the components of the final SCO blend and important inspections; the heavy crude feedstock used for the example is also shown. The SCO rate is 85.2 KBPSD with 20.3° API gravity and 2.6 W % sulfur. The typical Canadian pipeline viscosity is met. The SCO contains 22.2 V % material boiling greater than 975° F., compared to 50.6 V % in the heavy crude. The SCO liquid yield as a percentage of the crude rate is 85.2 V %. This is a high value considering that a portion of the crude is utilized to produce the required hydrogen and upstream energy requirements.

TABLE 4

| Example 2: Summary of Flowrates Basis: 100 KBPSD of Undiluted Bitumen | |
|---|---|
| Stream | Flowrate, kBPSD |
| Bitumen to Crude Still | 100.0 |
| AGO to SCO Blending | 17.6 |
| Atmospheric Residue to Vacuum Still | 82.4 |
| VGO to SCO Blending | 27.7 |
| Vacuum Residue to SDA Unit | 54.7 |
| SDA Asphaltenes to Gasification or Fuel | 16.9 |
| SDA DAO | 37.9 |
| DAO to SCO (Bypass) | 17.7 |
| DAO to Ebullated-Bed Unit | 20.2 |
| Ebullated-Bed Products | 21.8 |
| Naphtha | 4.8 |
| Diesel | 7.7 |
| VGO | 6.2 |
| Unconverted Residue | 3.2 |
| Total SCO | 85.2 |
| Hydrogen Required, MMSCFD | 40.5 |
| Syngas Export from Gasifier, MM Btu/Day | 81,200 |

TABLE 5

| SCO Yield | | | |
|---|---|---|---|
| | Units | Feed | SCO |
| Total SCO | BPSD | 100,000 | 85,220 |
| Yield on Crude | V % | — | 85.22 |
| Gravity | ° API | 9.3 | 20.3 |
| Sulfur | W % | 4.29 | 2.59 |
| Nitrogen | W % | 0.40 | 0.20 |
| Conradson Carbon Residue | W % | 13.6 | 3.8 |
| Nickel + Vanadium | Wppm | 290 | 45 |
| Distillation | | | |
| $C_4$-350° F. | V % | — | 6.2 |
| 350-650° F. | V % | 17.6 | 29.6 |

TABLE 5-continued

| SCO Yield | | | |
|---|---|---|---|
| | Units | Feed | SCO |
| 650-975° F. | V % | 31.8 | 42.0 |
| 975° F.+ | V % | 50.6 | 22.2 |
| Viscosity @7° C. | cSt | — | <350 |

The invention described herein has been disclosed in terms of specific embodiments and applications. However, these details are not meant to be limiting and other embodiments, in light of this teaching, would be obvious to persons skilled in the art. Accordingly, it is to be understood that the drawings and descriptions are illustrative of the principles of the invention, and should not be construed to limit the scope thereof.

I claim:

1. A novel process configuration process for converting heavy oil or bitumen feedstocks to transportable synthetic crude oil comprising:

a) feeding a bitumen or heavy oil feedstock having an API gravity of less than 15°, sulfur content greater than 3 weight %, and a vacuum residue content of greater than 35%, to a crude still to provide an atmospheric residue stream, a straight run atmospheric gas oil stream, and diluent stream; and b) feeding a portion of said atmospheric residue stream to a vacuum fractionator to create a vacuum residue stream and a straight run vacuum gas oil stream, bypassing a second portion of said straight run atmospheric residue from further processing, and bypassing a third portion of said straight run atmospheric residue for processing in a solvent deasphalter; and c) feeding said vacuum residue stream along with said third portion of said atmospheric residue stream to a solvent deasphalter to produce a deasphalted oil stream and an asphaltene stream;

d) feeding a portion of the deasphalted oil stream and a hydrogen stream to a ebullated-bed reactor system to create a full-range liquid conversion product stream and a recovered butanes stream and bypassing the remaining portion of said deasphalted oil stream from further processing; and e) blending said full-range liquid conversion product stream, said bypassed portion of the deasphalted oil stream that was not further processed in step d) above, said bypassed second portion of the atmospheric residue stream, said straight run vacuum gas oil stream, said recovered butanes stream and said straight run atmospheric gas oil stream to create a synthetic crude oil.

2. The process of claim 1 wherein the overall conversion percentage in step d) is greater than 70% wt.

3. The process of claim 1 wherein the overall conversion percentage in step d) is greater than 75% wt.

4. The process of claim 1 wherein said hydrogen stream from step d) is obtained via gasification of said asphaltene stream from step c).

5. The process of claim 1 wherein a portion of the atmospheric residue stream from step a) bypasses step b) and is fed into the solvent deasphalter of step c) along with the vacuum residue stream.

6. The process of claim 1 where between 10 and 80 percent of said deasphalted oil stream produced in step c) is bypassed from further processing.

7. The process of claim 1 where a portion of the straight run atmospheric gas oil stream, vacuum gas oil stream or full-range liquid conversion product stream are not included in the synthetic crude.

8. The process of claim 1 where the straight run vacuum and atmospheric gas oil streams are hydrotreated or hydrocracked prior to be blended into the synthetic crude oil.

* * * * *